US006593697B1

(12) United States Patent
Aarnink et al.

(10) Patent No.: US 6,593,697 B1
(45) Date of Patent: Jul. 15, 2003

(54) RESISTOR ASSEMBLY AND CATHODE RAY TUBE

(75) Inventors: Wilhelmus Albertus Maria Aarnink, Eindhoven (NL); Johan Cornelis Compter, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 163 days.

(21) Appl. No.: 09/698,766

(22) Filed: Oct. 27, 2000

(30) Foreign Application Priority Data

Oct. 29, 1999 (EP) ..... 9920357

(51) Int. Cl.[7] ..... H01J 13/46

(52) U.S. Cl. ..... 315/58; 315/3; 315/51; 338/283; 338/296; 338/308

(58) Field of Search ..... 315/58, 3, 64, 315/66, 67, 51, 52; 338/283, 287, 296, 308

(56) References Cited

U.S. PATENT DOCUMENTS 4,786,842 A * 11/1988 Shimoma et al. ..... 313/417
5,914,559 A * 6/1999 Muchi et al. ..... 313/414
6,005,472 A * 12/1999 Mitsuhashi ..... 338/308
6,011,349 A * 1/2000 Amano et al. ..... 313/417

FOREIGN PATENT DOCUMENTS

EP 0036901 A1 10/1981 ..... H01J/29/96

* cited by examiner

*Primary Examiner*—Don Wong
*Assistant Examiner*—Thuy Vinh Tran

(57) ABSTRACT

The invention relates to a resistor assembly for dividing an applied voltage into an intermediate voltage being below the applied anode voltage in a cathode ray tube. The resistor assembly comprises an insulating substrate and a resistive voltage divider including a first and a second resistive layer provided on the insulating substrate, and an additional resistive network with a first network terminal and a second network terminal. The additional resistive network is coupled in series with the first resistive layer. Furthermore, the additional resistive network comprises first and second resistive portions which are releasably coupled to the network terminals via bridge connections. According to the invention, the first and second resistive portions have substantially different resistance values for selecting a predetermined resistance value from a range of resistance values of the additional resistive network.

20 Claims, 3 Drawing Sheets

RESISTOR ASSEMBLY AND CATHODE RAY TUBE

BACKGROUND OF THE INVENTION

1. Field of the Invention

Figure 1:
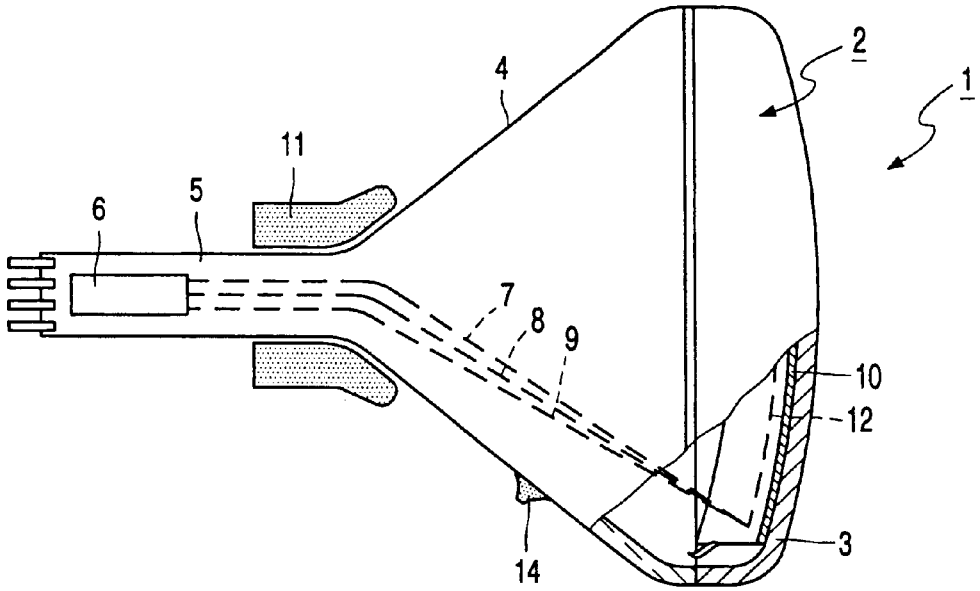
FIG. 1 PRIOR ART

The invention relates to a resistor for dividing an applied voltage into an intermediate voltage being below the applied voltage. The invention further relates to a cathode ray tube and an electrode gun.

2. Description of the Related Art

Such a resistor assembly is known from European patent application EP-A-36901. The resistor assembly described in this document is used in electron guns for cathode ray tubes (CRT). The known resistor assembly is mounted on the electron gun in the neck of the CRT. A first terminal of the resistor assembly is connected to a stem pin of the electron gun of the cathode ray tube, a second terminal of the resistor assembly is coupled to the anode of the cathode ray tube and a third terminal of the resistor assembly is connected to an intermediate grid of the electron gun of the cathode ray tube. The resistor assembly is used for supplying the intermediate voltage to the intermediate grid. This intermediate voltage is divided by the resistive voltage divider from the difference between the anode voltage and a ground or zero voltage. Normally, the voltage difference between the anode and the cathode is approximately 30 kV and the voltage difference between the potential of the intermediate grid and the potential of the cathode is approximately 15 kV. The intermediate voltage is defined by the ratio of the resistance of the first and second resistive layers. In order to obtain the intermediate voltage as a predetermined ratio of the anode voltage, the ratio of the resistance between the first and third terminal and the second and third terminal, respectively, is adjusted in a calibration step of the manufacturing process, for example, by selectively releasing one or more bridge connections in the additional resistive network.

Normally, the resistive layers are meandered or have a zig-zag shape. Design rules of the manufacturing process of the resistor assembly stipulate a minimum distance between adjacent branches of the resistive layers and also a maximum electric field strength per unit length of resistive layer. Furthermore, the resistor assembly has to fit in the neck of the CRT and connections have to be made between the third terminal and the intermediate grid of the CRT and between the second terminal and the anode of the CRT. Therefore, the resistor assembly normally has an elongated shape and its length is one of the factors that determine the length of the electron gun.

Furthermore, in the known resistor assembly, the resistive portions of the additional resistive network have approximately an identical resistance and, together with the bridge connections, then occupy a relatively large area of the resistor assembly in order to provide the assembly with a predetermined resistance value by selecting one or more resistive portions of the additional network. Manufacturing tolerances induce a deviation of the predetermined ratio of the first and second resistive layers. In order to obtain a predetermined ratio of the resistive voltage divider in a calibrating step, the actual ratio of the first and second resistive layers is measured and a predetermined resistance of the additional resistive network is selected by releasing one or more bridge connections to match the ratio of the series circuit of the first resistor together with the additional resistive network and the second resistor to the predetermined ratio of the resistive voltage divider. This additional resistive network occupies a relatively large area of the resistor assembly and determines, amongst other factors, the length of the resistor assembly.

SUMMARY OF THE INVENTION

It is an object of the invention to reduce the length of the resistor assembly without altering the current design rules of the manufacturing process. This object is achieved using first and second resistive portions having different resistance values, an optimal choice of the resistance values of the respective first and second portions can be made. As a result, a maximum range of predetermined values of the resistance of the additional resistive network can be obtained with a minimum number of resistive portions and bridge connections. By suitable choice of the resistance value of the first and second resistive portions, the area occupied by the additional resistive network on the substrate can be substantially reduced as compared to the area occupied by the resistive portions of the known resistor assembly, which portions have an equal size together with the bridge connections and define the same range of resistance values when the same design rules of the manufacturing process are applied. The length of the resistor assembly can thus be reduced. As a result, also the length of the electron gun and the complete cathode ray tube can be further reduced. This is an important advantage because the market demands shorter CRTs for use in televisions and computer monitors.

Furthermore, the predetermined value of the additional resistive network can be obtained by fewer releasing steps of the bridge connections, which saves time in the manufacturing process.

A particular embodiment of the resistor assembly according to the invention is characterized in that the resistance of the first resistive portion is twice that of the second resistive portion. By using a 1:2 ratio between the first and second resistive portions, a range of values 0, 1R, 2R or 3R can be obtained for a series circuit of the resistive portions, or a range of values 0, 2/3 R, R or 2 R can be obtained for a parallel circuit of the resistive portions.

A further embodiment of the resistor assembly according to the invention is characterized in that the additional resistive network comprises a third resistive portion which is releasably connected to the network terminals via a further bridge connection, and the ratios of the resistance of the first, second and third resistive portions are equal to 1:2:4. In this embodiment, a range of 7 values can be obtained in the range from 0,1,2,3 . . . 7 R for a series circuit of the resistive portions and a range of 0, 2/3R, R, 5/4 R, 4/3 R, 2R, 4R can be obtained for a parallel circuit of the resistive portions.

A further embodiment of the resistor assembly according to the invention is characterized in that the resistive layers, the resistive areas and the bridge connections comprise respective ruthenate lead systems of different ratios of lead and ruthenate, respectively.

A further embodiment of the resistor assembly according to the invention is characterized in that the resistor assembly comprises an insulating layer covering the first and the second resistor and the additional resistive network. For example, a high voltage glass having a relatively low melting point of, for example, 600° C. can be applied across the resistive layers and the resistive areas.

It is a further object of the invention to provide an electron gun with a reduced length.

It is a further object of the invention to provide a cathode ray tube with a reduced length of the neck.

BRIEF DESCRIPTION OF THE RELATED DRAWINGS

These and other aspects of the invention are apparent from and will be elucidated with reference to the embodiments described hereinafter.

Figure 2:
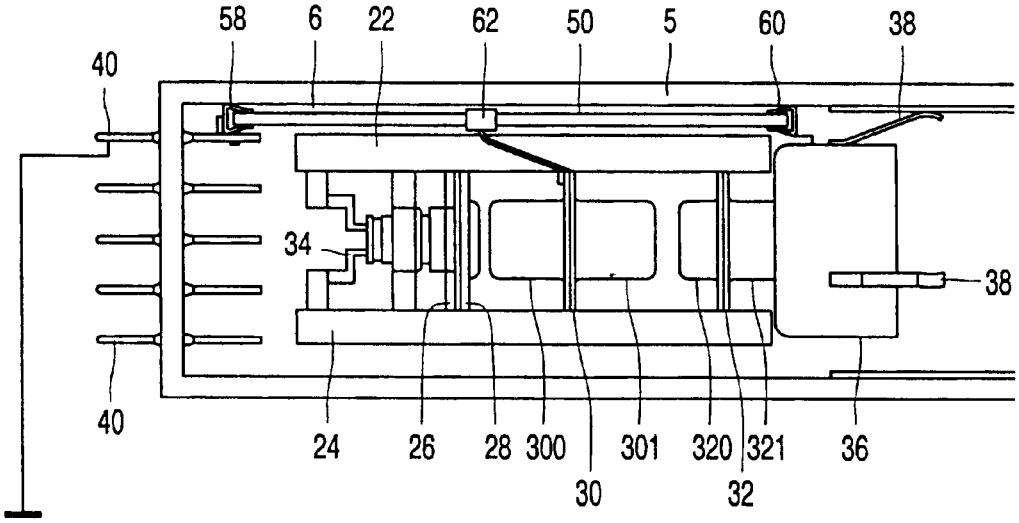
FIG. 2 PRIOR ART
Figure 3:
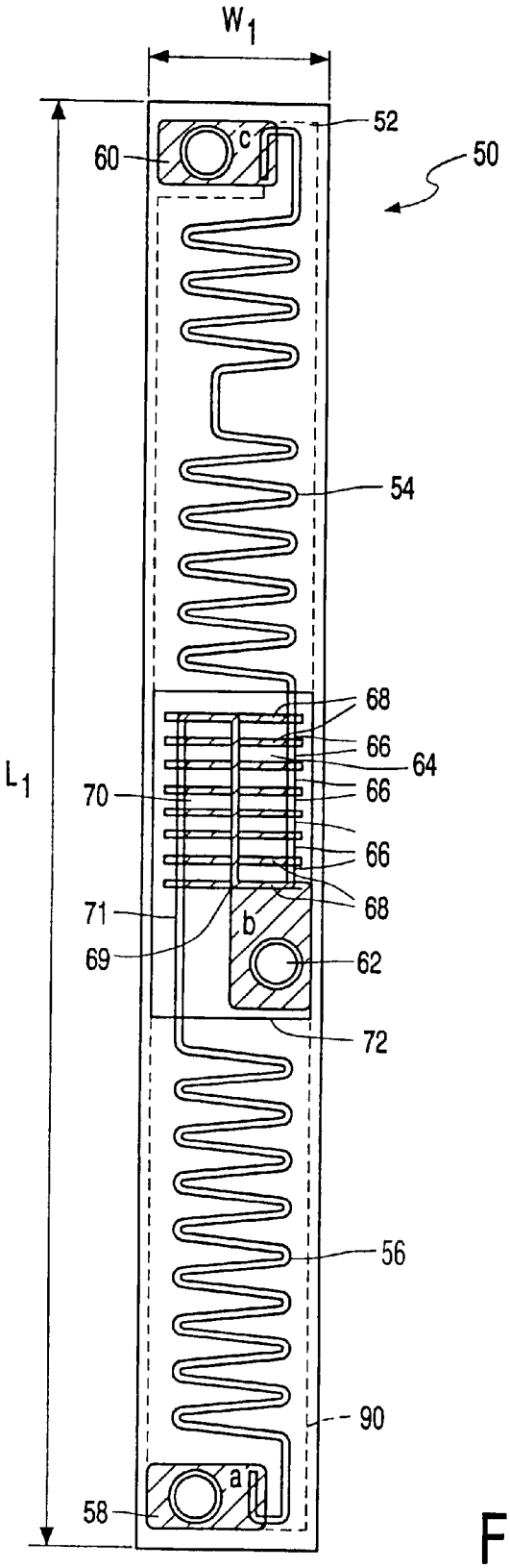
FIG. 3 PRIOR ART
Figure 4:
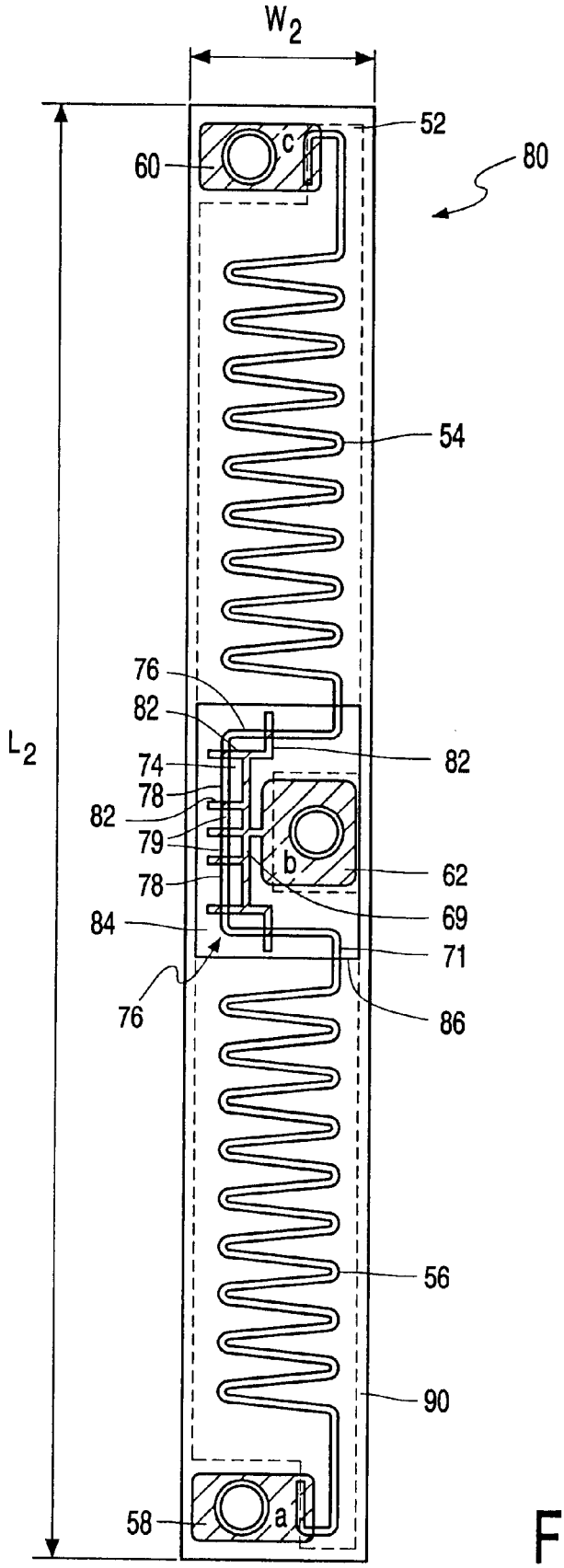

In the drawings:

FIG. 1 is a side elevation, partly broken away, of a conventional color display tube, FIG. 2 is a side elevation of an electron gun assembly including a resistor assembly, FIG. 3 shows a conventional resistor assembly and FIG. 4 shows a resistor assembly according to the invention.

It should be noted that the drawings are schematical and are generally not drawn to scale.

DETAILED DESCRIPTION OF THE PRESENTLY PREFERRED EMBODIMENTS

The cathode ray tube 1 shown in FIG. 1 comprises an evacuated glass envelope 2 with a neck 5, a funnel-shaped part 4 and a front panel 3, which may be either curved or flat. A display screen 10 having a pattern of, for example, lines or dots of phosphors luminescing in different colors (e.g. red, green and blue) may be arranged on the inner side of the panel 3. A thin mask 12 supported by a frame is positioned at a small distance from the display screen 10. The mask 12 may be an apertured mask having circular or elongate apertures, or a wire mask. During operation of the tube, an electron gun system 6 arranged in the tube neck 5 sends electron beams 7, 8, 9 through the mask 12 to the display screen 10 so that the phosphors will emit light. The electron beams have a small mutual angle causing, at the proper mask-to-screen distance, the electron beams to only impinge on the phosphors of the associated color. A deflection device 11 ensures that the electron beams systematically scan the display screen 10.

In this application, the term electron gun should be considered to have a wide meaning. For instance, it may refer to an electron gun of a color picture tube as shown in FIG. 1 and described above. Another example is a monochromatic tube in which the electron gun generates only electron beam. The present invention is also applicable to other types of display devices comprising an electron gun which generates one or more electron beams. For this application, the three-color electron gun will be used to illustrate the invention; this should not be considered as limiting the invention.

FIG. 2 shows the electron gun system 6 of a conventional cathode ray tube in more detail. This gun comprises a pair of insulating glass beads 22, 24, a plurality of grid electrodes 26,28,30,32 attached to the glass beads 22, 24 and a cathode structure 34 attached to the glass beads. The cathode structure 34 emits three electron beams 7,8,9 (FIG. 1) which are focused and accelerated by the grid electrodes 26,28,30,32 and then strike the red, green and blue phosphors coated on the inner side of the display screen 10 of the tube envelope 2. Grid electrodes 26,38,30,32 are arranged along the electron beam travelling direction and each electrode has three apertures corresponding to the three electron beams. First and second grid electrodes 26,28 are plate-shaped electrodes positioned near the cathode structure 34. The third electrode 30, which is an intermediate electrode of the main electron lens of the electron gun, has two cup-shaped structures 300, 301. The fourth electrode 32 has also two cup-shaped electrodes 320, 321. A cup-shaped convergence electrode 36 is mounted on cup-shaped electrode 321 facing the display screen 10. Convergence electrode 36 has three apertures for passing the three electron beams, respectively. Three bulb spacers 38 are attached to the convergence electrode 36. One end of each bulb spacer 38 abuts an inner surface of the neck and the electron gun assembly in the neck. The cathode structure side of the electron gun assembly is held to stem pins 40 by lead wires (not shown) connecting the cathode structure 34 and the grid electrodes 26,28. The bulb spacers 38 are in electrical contact with an inner contact layer on the tube envelope (not shown). The inner conductive layer is in electrical contact with the anode button 14, so that the anode voltage can be applied to the convergence electrode 32 and to the fourth electrode 36. In order to obtain an intermediate voltage for the intermediate electrode 30, a resistor assembly 50 is mounted on the electron gun assembly 6, such that a resistive voltage divider is present between the applied anode voltage and the applied ground voltage.

FIG. 3 shows a conventional resistor assembly. The conventional resistor assembly 50 comprises an insulating substrate 52 and a resistive voltage divider including a first and a second resistive layer 54,56 coupled in series between a first terminal 58 and a second terminal 60 of the resistor assembly 50. The first terminal 58 of the resistor assembly is connected to the first electrode 26 (FIG. 2) of the CRT, the second terminal 60 of the resistor is coupled via the fourth electrode 32 (FIG. 2) to the anode of the CRT, and a third terminal 62 is connected to a node between the first and the second resistive layer 54,56. The third terminal 62 is coupled to the intermediate electrode 30 (FIG. 2) of the CRT. The first and second resistive layers 54,56 may have a meandering or zig-zag shape. Furthermore, an additional resistive network 64 is coupled in series with the first resistive layer 54 and the third terminal 62. The additional resistive network 64 comprises resistive portions 66 connected in series. Furthermore, each node between two resistive portions 66 is releasably connected via bridge connections 68 to one of the network terminals 69,71. In the conventional resistor assembly, the resistive portions 66 have an equal resistance In practice, the sum of the resistance of the first and second resistive layers 54,56 is, for example, 2.5±0.3 GigaOhm. The predetermined ratio of the voltage divider should be, for example, 0.6±0.004.

The first and second resistive layers 54,56 and the resistive portions 66 comprise, for example, a high-resistive ruthenate lead system. The high-resistive lead ruthenate system comprises, for example, 56.1% PbO and 6.4% Ru. The bridge connections 68 comprise, for example, a low-resistive ruthenate lead system comprising 57.8% Pbo and 16.3 Ru. The insulating substrate is made of aluminum oxide. Furthermore, an insulating layer 90 covers the first and second resistive layers 54,56 and the additional resistive network 64.

In order to obtain a predetermined division ratio of the resistive voltage divider formed by the first and the second resistive layer 54,56 of the resistor assembly 50 in a measurement step of the manufacturing process, the actual ratio of the first and the second resistive layer 54,56 is measured. Thereafter, in a calculation step, a predetermined resistance of the additional resistive network 64 is calculated to obtain a match of the ratio of the first resistive layer 54 together with the selected resistance of the additional network 64 and the second resistive layer 56 with the predetermined ratio of the first and second resistive layers 54,56. Furthermore, the number of bridge connections 68 in the additional network 64, which have to be released, is determined. Thereafter, in a calibration step, the determined bridge connections 68 are released, for example, by sand-blasting or laser ablation. In this example, up to 7 bridge connections may be released for selecting one of a range of 7 predetermined resistance values. In order to increase the range of division ratios, a second additional network 70 is coupled between the second resistive layer 56 and the third terminal 62. The second additional network 70 also comprises resistive portions 66 and bridge connections 68. The area occupied by the two additional networks 64, 70 together with the third terminal 62 is indicated by a first rectangle 72. The length L1 of the conventional resistor assembly is, for example, 50 mm. The width W1 of the conventional resistor assembly is, for example, 5,7 mm. In the resistor assembly according to the invention, this area and therefore also the length of the resistor assembly and thus of the CRT can be substantially reduced.

FIG. 4 shows a resistor assembly 80 according to the invention. The resistor assembly 80 comprises an insulating substrate 52 and a resistive voltage divider including a first and a second resistive layer 54,56 coupled in series between a first terminal 58 and a second terminal 60. The first terminal 58 of the resistor assembly 80 is connected to the first electrode 32 (FIG. 2) of the CRT, the second terminal 60 of the resistor assembly 80 is coupled to the anode of the CRT, and a third terminal 62 is connected to a node between the first and the second resistive layer 54,56. The third terminal 62 is coupled to the focus grid 34 (FIG. 2) of the CRT. Furthermore, an additional resistive network 74 is coupled in series with the first resistive layer 54 and the third terminal 72. The resistive network 84 comprises first, second and third resistive portions 76,78,79 which are coupled in series. A releasable bridge connection 82 for providing a connection between the node and one of the network terminals 69,71 is present between each node of the adjacent resistive portion. The first and second resistive portions 76,78 and also the third resistive portion 79 have different resistances. Preferably, the ratios of resistance values of the first, second and third resistive portions 76,78,79 are equal to 1:2:4, for example, 17 Mohm, 34 Mohm, 68 Mohm. In practice, the first, second and third resistive portions 76,78, 79 comprise a high-resistive ruthenate lead system, comprising, for example, 56,1% PbO and 6,4% Ru. The bridge connections 82 comprise a low-resistive ruthenate lead system, comprising, for example, 57,1% PbO and 16,3% Ru. Furthermore, the sum of the resistances of the first and second resistive layers 54,56 is, for example, 2,75±0,25 GigaOhm. Furthermore, the insulating substrate 52 comprises aluminum oxide.

In order to obtain a predetermined division ratio of the resistive voltage divider formed by the first and second resistive layers 54,56 in a measurement step in the manufacturing process, the division ratio of the first and the second resistive layer is measured. Thereafter, in a calculation step, a predetermined resistance of the additional resistive network 84 is calculated to obtain a match of the division ratio of the first resistive layer 54 together with the additional resistive network 84 and the second resistive layer 56 with the predetermined division ratio. Also the number and position of bridge connections 82 which have to be released is determined. Thereafter, in a calibration step, the determined bridge connections 82 are released, for example by, sand-blasting or laser ablation. In this example, up to 4 bridge connections 82 may be released to select one of 7 predetermined resistance values of the additional resistive network. Preferably, a second additional resistive network 84 is coupled in series with the second resistive layer 56 and the third terminal 62 to increase the range of division ratios. The second additional network 84 also comprises first, second and third resistive portions 76,78,79 and bridge connections 82. Furthermore, an insulating layer 90 covers the first and second resistive layers 54,56 and the additional resistive network 74,84.

The area occupied by the first and second additional network 74,84 formed by the first, second and third resistive portions 76,78,79 and its related bridge connections 82 is indicated by a second rectangle 86. The area of the second rectangle 86 is now substantially reduced as compared to the area indicated by the first rectangle 72. As a result, the length L2 of the resistor assembly 80 can be reduced by about 4.4 mm, namely, from 50 mm of the conventional resistor assembly 50 to 45.0 mm of the resistor assembly according to the invention 80. The width W2 of the resistor assembly according to the inventions is, for example, 4,7 mm. The reduced length L2 of the resistor assembly 80 according to the invention allows a further reduction of the length of the electron gun assembly, the neck 5 of the CRT and the length of the CRT.

Instead of a series circuit of the first, second and third resistive portions of the additional resistive network, a parallel circuit of the first, second and third resistive portions may be used. In that case, the bridge connections are connected in series with each of the respective first, second and third resistive portions and one of the network terminals 69,71.

It should be noted that the above-mentioned embodiments illustrate rather than limit the invention, and that those skilled in the art will be able to design many alternative solutions without departing from the scope of the claims.

What is claimed is:

1. A resistor assembly (80) for dividing an applied voltage into an intermediate voltage being below the applied voltage, said resistor assembly (80) comprising:

an insulating substrate, (52);

a resistive voltage divider including a first and a second resistive layer (54, 56) provided on said insulating substrate, (52); and an additional resistive network (74) with a first network terminal (69) and a second network terminal (71), the said additional resistive network (74) being coupled in series with said first resistive layer (54), wherein said additional resistive network (54) includes at least two resistive portions (76,78,79) which are releasably coupled to said first and second network terminals via at least one bridge connection (82), each bridge connection (82) having a resistance which is substantially lower than a resistance of said at least two resistive portions for adjusting a predetermined ratio of said resistive voltage divider, and wherein a first resistive portion (76) and a second resistive portion (78) have substantially different resistance values for selecting a predetermined resistance value from a range of resistance values of said additional resistive network (74).

2. The resistor assembly (80) as claimed in claim 1, wherein the resistance of said first resistive portion (76) is twice the resistance of said second resistive portion (78).

3. The resistor assembly (80) as claimed in claim 1, wherein said first and second resistive portions (76, 78) are coupled in a series circuit, said at least one bridge connection (82) being coupled in parallel with said first and second resistive portions (76, 78), respectively.

4. The resistor assembly (80) as claimed in claim 1, wherein said first and second resistive portions (76, 78) are coupled in a parallel circuit, said at least one bridge connection (82) being coupled in series with said first and second resistive portions (76, 78), respectively.

5. The resistor assembly (80) as claimed in claim 1, wherein said additional resistive network 80 includes a third resistive portion (79) which is releasably connected to said network terminals (69,71) via a further bridge connection (82), the ratios of the resistance values of said first, second and third resistive portions (76,78,79) being equal to 1:2:4.

6. The resistor assembly (80) as claimed in claim 1, wherein said first and second resistive layers (54,56) comprise a ruthenate lead system.

7. The resistor assembly (80) as claimed in claim 1, wherein said first and second resistive portions (76,78) comprise a ruthenate lead system.

8. The resistor assembly (80) as claimed in claim 1, wherein said at least one bridge connection (82) comprises a ruthenate lead system.

9. The resistor assembly (80) as claimed in claim 1, wherein said first and second resistive layers (54,56) are zigzag-shaped.

10. The resistor assembly (80) as claimed in claim 1, said resistor assembly (80) includes an insulating layer (90) covering said first and second resistive layers (54,56) and said additional resistive network (74).

11. An electron gun (6) for a cathode ray tube (1), said electron gun (6) comprising:

a resistor assembly (80) including:

an insulating substrate, (52);

a resistive voltage divider including a first and a second resistive layer (54, 56) provided on said insulating substrate, (52); and an additional resistive network (74) with a first network terminal (69) and a second network terminal (71), said additional resistive network (74) being coupled in series with said first resistive layer (54), wherein said additional resistive network (54) includes at least two resistive portions (76,78,79) which are releasably coupled to said first and second network terminals via at least one bridge connection (82), each bridge connection (82) having a resistance which is substantially lower than a resistance of said at least two resistive portions for adjusting a predetermined ratio of said resistive voltage divider, and wherein a first resistive portion (76) and a second resistive portion (78) have substantially different resistance values for selecting a predetermined resistance value from a range of resistance values of said additional resistive network (74).

12. The electron gun (6) as claimed in claim 11, wherein the resistance of said first resistive portion (76) is twice the resistance of said second resistive portion (78).

13. The electron gun (6) as claimed in claim 11, wherein said first and second resistive portions (76, 78) are coupled in a series circuit, said at least one bridge connection (82) being coupled in parallel with said first and second resistive portions (76, 78), respectively.

14. The electron gun (6) as claimed in claim 11, wherein said first and second resistive portions (76, 78) are coupled in a parallel circuit, said at least one bridge connection (82) being coupled in series with said first and second resistive portions (76, 78), respectively.

15. The electron gun (6) as claimed in claim 11, wherein said additional resistive network (80) includes a third resistive portion (79) which is releasably connected to said network terminals (69,71) via a further bridge connection (82), the ratios of the resistance values of said first, second and third resistive portions (76,78,79) being equal to 1:2:4.

16. A cathode ray tube (1), comprising:

a resistor assembly (80) including:

an insulating substrate, (52);

a resistive voltage divider including a first and a second resistive layer (54, 56) provided on said insulating substrate, (52); and an additional resistive network (74) with a first network terminal (69) and a second network terminal (71), said additional resistive network (74) being coupled in series with said first resistive layer (54), wherein said additional resistive network (54) includes at least two resistive portions (76,78,79) which are releasably coupled to said first and second network terminals via at least one bridge connection (82), each bridge connection (82) having a resistance which is substantially lower than a resistance of said at least two resistive portions for adjusting a predetermined ratio of said resistive voltage divider, and wherein a first resistive portion (76) and a second resistive portion (78) have substantially different resistance values for selecting a predetermined resistance value from a range of resistance values of said additional resistive network (74).

17. The cathode ray tube (1) as claimed in claim 16, wherein the resistance of said first resistive portion (76) is twice the resistance of said second resistive portion (78).

18. The cathode ray tube (1) as claimed in claim 16, wherein said first and second resistive portions (76, 78) are coupled in a series circuit, said at least one bridge connection (82) being coupled in parallel with said first and second resistive portions (76, 78), respectively.

19. The cathode ray tube (1) as claimed in claim 16, wherein said first and second resistive portions (76, 78) are coupled in a parallel circuit, said at least one bridge connection (82) being coupled in series with said first and second resistive portions (76, 78), respectively.

20. The cathode ray tube (1) as claimed in claim 16, wherein said additional resistive network (80) includes a third resistive portion (79) which is releasably connected to said network terminals (69,71) via a further bridge connection (82), the ratios of the resistance values of said first, second and third resistive portions (76,78,79) being equal to 1:2:4.

* * * * *